US005221358A

United States Patent [19]

Malloy

[11] Patent Number: 5,221,358

[45] Date of Patent: Jun. 22, 1993

[54] DESCALING/DEGLASSING SALT COMPOSITION AND METHOD

[75] Inventor: James C. Malloy, Ferndale, Mich.

[73] Assignee: Kolene Corporation, Detroit, Mich.

[21] Appl. No.: 745,915

[22] Filed: Aug. 16, 1991

[51] Int. Cl.[5] ..... C09K 13/02; C09K 13/04; C09K 13/08; C23G 1/02

[52] U.S. Cl. ..... 134/3; 252/79.5; 252/79.2; 252/79.3; 252/80

[58] Field of Search ..... 134/3; 252/79.5, 79.2, 252/79.3, 80

[56] References Cited

U.S. PATENT DOCUMENTS

| | | | |
|---|---|---|---|
| 2,468,006 | 4/1949 | Webster | 204/145 F |
| 2,630,393 | 3/1953 | Francis | 134/3 |
| 3,260,619 | 7/1966 | Shoemaker et al. | 134/3 |

*Primary Examiner*—Theodore Morris
*Assistant Examiner*—Zeinab El-Arini
*Attorney, Agent, or Firm*—Calfee, Halter & Griswold

[57] ABSTRACT

An improved salt and method for descaling and deglassing metals, especially metal forgings and even more specifically, titanium forgings wherein glass has been utilized as a forging lubricant, is provided. A composition of the salt has at least one alkali metal hydroxide, at least one alkali metal nitrate and at least one alkali metal or alkaline earth metal fluoride. Preferably, the salt includes from about 60–75% sodium hydroxide, from about 15–25% potassium hydroxide, from about 3–6% sodium fluoride, and from about 5–10% sodium nitrate. The specific preferred composition is one which contains about 67.5% sodium hydroxide, about 18% potassium hydroxide, about 4.5% sodium fluoride and about 10% sodium nitrate.

11 Claims, No Drawings

DESCALING/DEGLASSING SALT COMPOSITION AND METHOD

FIELD OF THE INVENTION

This invention relates generally to improved salts and method which will aggressively descale and deglass metal or metal alloy work pieces, and more particularly, to an aggressive salt and method which will quickly and efficiently deglass and descale work pieces which have been both scaled and contain glass compositions, in particular relatively passive or inert glass compositions, such as boron-containing glasses used as forging lubricants, which are difficult to remove by conventional methods.

BACKGROUND OF THE INVENTION

Certain types of forgings, e.g. titanium turbine blade forgings, utilize glass lubricants during the forging operation. During this forging operation, a scale forms on the work piece. Thus, at the conclusion of the forging operation, it is necessary to remove both the scale which is formed and any remaining glass lubricant which has solidified on the surface of the parts. In certain cases, depending upon the particular glass composition, the remaining solidified glass can be reasonably quickly removed utilizing an oxidizing alkaline bath salt. Such a salt is sold under the trademark DGS by Kolene Corporation of Detroit Mich., which salt contains sodium hydroxide, potassium hydroxide, sodium chloride and sodium nitrate. However, with the more resistant type glasses, such as the boron-containing glasses, this type of salt is generally not aggressive enough to remove the glass and also perform the descaling in a commercially acceptable period of time.

Other types of salts which are available for deglassing which are more aggressive than the Kolene DGS salt are a group of salts sold by Kolene under trademark KASTECH CERAM-X. These salts contain hydroxides and fluorides, (either sodium or potassium hydroxides and sodium or potassium fluorides). These salts while being reasonably effective in removing even these relatively inert glass compositions, nevertheless have a drawback, especially when used on titanium, in that they tend to produce hydrogen pick-up in the work piece, which can be detrimental, especially in the case of titanium.

Thus, it is necessary to provide an aggressive descaling/deglassing salt which will act relatively quickly to both descale and deglass work pieces when more inert glasses are used, and also which will avoid hydrogen pick-up when used on titanium.

SUMMARY OF THE PRESENT INVENTION

According to the present invention, an improved salt for descaling and deglassing metals, especially metal forgings wherein glass has been utilized as a forging lubricant, is provided. Broadly, the salt contains one or more alkali metal hydroxide, one or more alkali metal nitrate, and one or more alkali metal or alkaline earth metal fluoride. A derivative composition range of the salt includes generally from about 60–75% sodium hydroxide, from about 15–25% potassium hydroxide, from about 3–6% sodium fluoride, and from about 5–10% sodium nitrate (by weight). The specific preferred composition is one which contains by weight about 67.5% sodium hydroxide, about 18% potassium hydroxide, about 4.5% sodium fluoride and about 10% sodium nitrate.

DESCRIPTION OF THE PREFERRED EMBODIMENT(S)

It has been found that in the descaling and deglassing of metal or metal alloy forgings, particularly forged titanium turbine blades, especially when a boron containing or other relatively inert glass is used as a lubricant, a fused anhydrous bath containing one or more alkali metal hydroxide, one or more alkali metal nitrate, and one or more alkali metal or alkaline earth metal fluoride is useful in quickly, effectively and thoroughly descaling and deglassing the resultant forging. In general, there should be between 5% and 20% by weight of the alkali metal nitrate(s), between 1% and 10% of the alkali metal or alkaline earth metal fluoride(s), the balance alkali metal hydroxide(s). An especially useful composition includes NaOH, KOH, $NaNO_3$, and NaF. Preferably the NaOH is in the range of about 60–75%, the KOH is in the range of about 15–25%, the sodium fluoride (NaF) is in the range of about 3–6% and the sodium nitrate ($NaNO_3$) is in the range of about 5–10% (by weight). A particular preferred composition is about 67.5% sodium hydroxide, about 18% potassium hydroxide, about 4.5% sodium fluoride and about 10% sodium nitrate.

To use a salt of the above composition, it is heated in a suitable pot or vessel until it melts or fuses. The work piece to be descaled/deglassed is immersed in the fused salt bath. It has been found that an operating temperature of from about 750° F. to about 900° F. (399° C. to 482° C.) preferably about 800° F. (427° C.) utilizing the above preferred composition is effective to quickly and rapidly deglass and descale the forged parts which have forging scale and boron-containing lubricating glass on their surfaces. The amount of time that the parts have to be immersed depends on the size of the part and the amount of scale but after about 15 minutes, the parts are removed and quenched in water. This effectively removes virtually all of the scale and remaining glass lubricant.

In an experimental procedure, two sets of 18 forged titanium turbine blades which were forged using an inert boron containing glass lubricant were treated in two different baths. The first group of 18 were in the "as-forged" condition, while the second group of 18 were in the "as-forged and heat treated" condition.

Two electrically heated salt bath furnaces were charged with fresh salt, melted, and allowed to stabilize at approximately 900° F. One of the two furnaces was charged with Kolene DGS salt which contains NaOH, KOH, $NaNO_3$, and NaCl, while the second furnace was charged with an experimental composition according to this invention having the preferred composition as disclosed on page 3, lines 21–24. Utilizing the two different compositions operating under similar conditions allowed side-by-side comparisons to be performed easily and contemporaneously.

The blades were each processed individually by suspending them from a piece of aluminum welding rod (to prevent the formation of a galvanic cell) while they were immersed in the molten salts. A cycle time of 15 minutes immersion in one of the two salts was chosen.

Initial tests involved processing one of each type of blades in the DGS salt at 900° F. for 15 minutes followed by water quenching. This process cycle showed only minimal glass removal/conversion. The surface appearance after forced air drying showed a somewhat crazed, yellow, powdery skin still present, indicating a residual glass lubricant.

One of each type of blade was then processed in the salt of this invention at 850° F. for 15 minutes and then water quenched and forced air dried. Examination showed a dull, medium gray color with a very thin powdery coating of alkali titanate. It appeared that all glass lubricant had been removed. To confirm that the glass was removed, the processed blades were pickled in a 20% solution of sulfuric acid at a temperature of 160° F. for 10 minutes. They were then water rinsed and forced air dried. Examination showed that no glass or scale remained; surface appearance was a uniform, bright silver color.

Multiple sets of blades were processed through both DGS salt and the experimental composition to confirm initial cleaning results. Without exception, the blades processed through the experimental composition for 15 minutes were 100% clean, while those processed through DGS for the same amount of time still had significant amounts of lubricant glass remaining.

The operating temperature of the DGS salt bath was about 900° F., while the temperature of the experimental salt bath was varied from a low of about 750° F. to a high of 900° F. Regardless of the experimental bath's temperature, all blades processed through it were virtually 100% clean in 15 minutes or less. In a production environment, an initial operating temperature of about 800° F. is preferred as a starting point.

Further, it has been found that the inclusion of NaCl in the fused bath inhibits, to some degree, the effectiveness of the deglassing/descaling function of the bath on titanium forged work pieces. Further, it has been observed in the past that the use of oxidizing agents such a $NaNO_3$ in a deglassing bath leads to produce water glass crystals which precipitate and cause difficultly in removing the sludge. Surprisingly, such crystals were not observed when using the present invention. The reason for this is not completely understood. However, it is believed that it results from some type of interaction between the fluoride and nitrate ions which block such formation of water glass.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

Having thus described the preferred embodiment, the invention is now claimed to be:

1. A salt bath composition comprising at least one alkali metal hydroxide, from about 5% to about 20% by weight of at least one alkali metal nitrate, and from about 1% to about 10% by weight of at least one fluoride selected from the group consisting of alkali metal fluorides and alkaline earth metal fluorides.

2. The salt bath composition as defined in claim 1 wherein there is sodium hydroxide, potassium hydroxide, sodium fluoride, and sodium nitrate.

3. The salt bath composition as defined in claim 2 comprising from about 60–75% sodium hydroxide, from about 15–25% potassium hydroxide, from about 3–6% sodium fluoride, and from about 5–10% sodium nitrate.

4. The salt bath composition as defined in claim 3 wherein there is about 67.5% sodium hydroxide, about 18% potassium hydroxide, about 4.5% sodium fluoride, and about 10% sodium nitrate.

5. A method of descaling/deglassing a metal or metal alloy part comprising the steps of:

immersing the part in a fused anhydrous bath comprising at least one alkali metal hydroxide, from about 5% to about 20% by weight of at least one alkali metal nitrate and from about 1% to about 10% by weight of at least one fluoride selected from the group of alkali metal and alkaline earth metal fluorides;

and removing the part from the bath.

6. The method as defined in claim 5 wherein there is sodium hydroxide, potassium hydroxide, sodium fluoride, and sodium nitrate.

7. The method as defined in claim 6 comprising from about 60–75% sodium hydroxide, from about 15–25% potassium hydroxide, from about 3–6% sodium fluoride, and from about 5–10% sodium nitrate.

8. The method as defined in claim 8 wherein there is about 67.5% sodium hydroxide, about 18% potassium hydroxide, and about 4.5% sodium fluoride, and about 10% sodium nitrate.

9. The method as defined in claim 5 wherein the metal being descaled is titanium.

10. The method as defined in claim 5 characterized by the step of quenching the part in water after removing from the bath.

11. The method as defined in claim 5 wherein the part is immersed in the bath for at least 15 minutes.

* * * * *